US005292577A

United States Patent [19]

Van Kerrebrouck et al.

[11] Patent Number: 5,292,577

[45] Date of Patent: Mar. 8, 1994

[54] NONWOVEN MATERIAL USED AS UNDERLAYER FOR A FABRIC COVERING SEATS INTENDED FOR PASSENGER TRANSPORT

[75] Inventors: Josef Van Kerrebrouck, Bernem; Hendrik Vercouter, Oostrozebeke, both of Belgium

[73] Assignee: Libeltex N.V., Meulebeke, Belgium

[21] Appl. No.: 818,912

[22] Filed: Jan. 10, 1992

[30] Foreign Application Priority Data

Jan. 11, 1991 [FR] France ..... 91 00309

[51] Int. Cl.[5] ..... A47C 7/00; A47C 27/00; B32B 5/26; B60N 2/44; B68G 11/02

[52] U.S. Cl. ..... 428/233; 5/459; 5/470; 5/502; 297/DIG. 5; 297/180.1; 428/236; 428/252; 428/253; 428/286; 428/287; 428/298; 428/302; 428/303; 428/332; 428/337; 428/338; 428/339; 428/354; 428/360; 428/398

[58] Field of Search ..... 5/459, 470, 502; 297/452, DIG. 5; 428/233, 236, 252, 253, 286, 287, 298, 302, 303, 332, 337, 338, 339, 354, 360, 398

[56] References Cited

U.S. PATENT DOCUMENTS

| | | | |
|---|---|---|---|
| 3,257,264 | 6/1966 | Scheuerman | 428/362 |
| 3,869,337 | 3/1975 | Hoppe et al. | 428/252 |
| 4,426,420 | 1/1984 | Likhyani | 428/360 |
| 4,481,256 | 11/1984 | Masuda et al. | 428/398 |
| 4,486,493 | 12/1984 | Burmester et al. | 428/253 |
| 4,520,066 | 5/1985 | Athey | 428/260 |
| 4,556,601 | 12/1985 | Kirayoglu | 428/339 |
| 4,563,387 | 6/1986 | Takagi et al. | 428/339 |
| 4,623,571 | 11/1986 | Yamamoto et al. | 5/459 |
| 4,750,443 | 6/1988 | Blaustein et al. | 5/459 |
| 4,961,238 | 10/1990 | Limb et al. | 5/502 |
| 5,141,805 | 8/1992 | Nohara et al. | 5/459 |

FOREIGN PATENT DOCUMENTS

| | | |
|---|---|---|
| 1414994 | 10/1964 | France . |
| 2125408 | 9/1972 | France . |
| 1032188 | 6/1966 | United Kingdom . |
| 1339237 | 11/1973 | United Kingdom . |
| 2000440 | 1/1979 | United Kingdom . |

*Primary Examiner*—James C. Cannon

*Attorney, Agent, or Firm*—Cushman, Darby & Cushman

[57] ABSTRACT

The invention relates to the use of a non woven material as underlayer for a fabric covering seats intended for passenger transport by road, rail or air.

The said nonwoven material is produced by a dry process and has an apparent density between 20 and 100 kg/m and a thickness between 4 and 20 mm. The said nonwoven material comprises a minimum of 50% of synthetic fibres of a thickness between 3 and 40 dtex and of a length between 2 and 12 cm. The fibres are needle bonded. When the nonwoven material is subjected to a static pressure of 20 cN/cm$^2$, it retains a minimum thickness of 2 mm.

The nonwoven material used in accordance with the invention is in particular intended for improving the evacuation of perspiration emanating from the user of the seat.

18 Claims, No Drawings

NONWOVEN MATERIAL USED AS UNDERLAYER FOR A FABRIC COVERING SEATS INTENDED FOR PASSENGER TRANSPORT

BACKGROUND OF THE INVENTION

The invention relates to the use of a nonwoven material as underlayer for a fabric covering seats intended for passenger transport by road, rail or air The invention also relates to the seat covering composed of a fabric with the said nonwoven material, adhesive bonded to it or not, as well as to the seat intended for passenger transport and provided with this covering.

By "nonwoven material" is understood what is normally called a nonwoven fabric, a nonwoven mat, or a felt.

In order to ensure the comfort of the user, a seat generally comprises: 1) a support ensuring the ergonomic comfort of the user of the seat; this support generally consists of dense foam, springs or bands; 2) a padding layer consisting of a foam less dense than that constituting the support (and optionally separated from the support by a separating film), and 3) a cover fabric. The padding layer and the cover fabric are responsible for the thermophysiological aspect of comfort.

A seat constructed in this manner has a particularly good insulating action, which entails perspiration on the part of the user. If this perspiration is not quickly evacuated, a disagreeable sensation of dampness results.

The insulating effect of the seat is principally due to the substantial thickness of dense foam constituting the support, the film separating the dense foam from the padding foam, and the closed character of the padding foam which encloses a multitude of air bubbles.

The evacuation of humidity due to perspiration on the part of the user is not possible through the thickness of the seat, because the block of foam constituting the support prevents the humidity from being carried away.

The humidity must therefore be eliminated either through the sides or by ventilation, that is to say by a pumping action due to movements and vibration.

The aim of the present invention is to make use of a nonwoven material as underlayer for the fabric covering a seat as replacement for the foam padding layer. It is a particular aim that the nonwoven material used in accordance with the invention should serve both as a padding layer and as a thermophysiological comfort layer.

More particularly, the present invention has the aim of using a nonwoven material which is capable of rapidly absorbing, in the contact zone between the user and the seat, the perspiration emanating from the user.

It is therefore the aim that the material used in accordance with the invention should, through its hydrophilic nature, be able to absorb the humidity rapidly before conveying it to the outside.

Another aim of the present invention is to use a nonwoven material capable of conveying the humidity in a direction parallel to the surface of the material.

The present invention also has the aim of using a nonwoven material permitting the evacuation of humidity by ventilation.

It is a particular aim that the material used in accordance with the invention should have characteristics of compressive strength and elasticity adequate for permitting the absorption, conveying and evacuation of humidity.

SUMMARY OF THE INVENTION

The subject of the present invention is the use of a nonwoven material as underlayer for a fabric covering seats intended for passenger transport (by road, rail or air) as a replacement for the traditional foam padding layer.

The nonwoven material used in accordance with the invention is produced by a dry process. It has a density between 20 and 100 kg/m$^3$ and preferably between 30 and 60 kg/m$^3$, with a thickness between 4 and 40 mm and preferably between 8 and 12 mm.

The nonwoven material used in accordance with the invention contains a minimum of 50% of synthetic fibres, which are preferably selected from polyester, polyamide and polyoxyamide fibres, or fibres of the "superabsorbent" type, or a mixture of these various fibres. By fibres of the "superabsorbent" type are understood fibres having an absorption capacity higher than 100%, that is to say fibres absorbing more than 1 g of water per gram of fibre. The "superabsorbent" fibres used are, for example, those marketed under the names Lansael ®, Fibersorb ®, or Bemliese ®.

The synthetic fibres selected are advantageously polyester fibres. The fibres used are preferably hydrophilic or are made hydrophilic by appropriate treatment.

The synthetic fibres included in the composition of the material used in accordance with the invention have a thickness between 3 and 40 dtex and preferably between 6 and 20 dtex, and a length between 2 and 12 cm and preferably between 5 and 7.5 cm.

The nonwoven material used in accordance with the invention may contain up to 50% of natural and/or artificial fibres, which may for example be cellulose (cotton, rayon, viscose) or wool fibres.

The fibres constituting the material used in accordance with the invention are needle bonded.

In one particular embodiment of the invention the said fibres are both needle bonded and heat bonded. In this case the nonwoven material must contain a certain percentage of "heat bonding" fibres.

By heat bonding fibres are understood fibres whose melting point is lower than that of the main fibres, or fibres having a surface layer whose melting point is lower than that of the interior part of the fibre ("two-component" fibres)

In another embodiment of the invention the fibres are bonded both by needling and by chemical bonding. This chemical bonding is effected by spraying the fibres with a resin, which may for example be an aqueous emulsion of polyacrylate or polyurethane resin.

The nonwoven material used in accordance with the invention has sufficient compressive strength to ensure that, when it is subjected to a static pressure of 20 cN/cm$^2$, (which corresponds to the pressure exerted by the weight of an average person), it will retain a minimum thickness of 2 mm. It is advantageous for this minimum thickness to be 4 mm.

This minimum thickness of 2 mm or even of 4 mm is necessary in order to allow the material to absorb the perspiration emanating from the user of the seat and to convey this humidity in a direction parallel to the surface of the material, or to convey it by ventilation.

The subject of the invention is also a covering for seats intended for passenger transport, which comprises a cover fabric and a nonwoven material, the said material having the characteristics enumerated above.

In another embodiment of the covering according to the invention the cover fabric and the nonwoven material may be adhesive bonded together by one of the techniques known to the men skilled in the art. This adhesive bonding may for example be effected with the aid of adhesive means such as a dispersion, an emulsion or a solution of adhesive, or such as a thermoplastic powder, film or coating. This adhesive means may for example be applied by atomisation, sprinkling, impregnation or impression.

Yet another subject of the present invention is a cover material for seats intended for passenger transport, which consists of a cover fabric adhesive bonded to a nonwoven material which has the characteristics enumerated above. The adhesive bonding may be effected by one of the techniques known to the men skilled in the art and enumerated above.

In addition, the invention has as a subject a seat intended for passenger transport (by road, rail or air) which has a covering or cover material according to the invention.

DETAILED DESCRIPTION

Additional characteristics of the invention will also emerge in the course of the description of examples of embodiment of the invention, these examples being in no way limitative.

EXAMPLE 1

The nonwoven material used in accordance with the invention comprises two types of fibres, which are available as a mixture under the reference "D-291 Quallofil ®" from the Dupont de Nemours Company. This is a mixture of hollow, four-channel thermobonding and polyester fibres of 13 dtex, the percentage of hollow volume being greater than 23% of the total volume of the fibre. The length of the fibres is 7 to 8 cm. A special finish gives this fibre a smooth, hydrophilic surface and a low inflammability character.

The mixture of fibres has been carded and napped by techniques well known to the men skilled in the art. The fibres were thereupon needle bonded and then heat bonded.

The material thus obtained has a thickness of 10 mm and an apparent density of 40 kg/m$^3$. It has a compressive strength such that, when subjected to a static pressure of 20 cN/cm$^2$, this material retains a thickness of 8.5 mm.

This nonwoven material has been tested in comparison with a standard foam on a "skin model" according to the standard DIN 504-101 Part 1. This standard is in addition proposed as a draft standard under the reference ISO/TC 38/SC 8 H 156.

The parameters tested are as follows: thermal resistance: $R_{ct}$ (measured in m$^2$ K/w), humidity transport resistance: $R_{ct}$ (measured in m$^2$ mbar/w), and humidity absorption capacity Fi (expressed in %) (weight of water absorbed per dry weight of product). These three parameters were measured under static conditions, that is to say by subjecting the nonwoven material or the foam to a static load of 20 cN/cm$^2$. The three parameters were also measured under dynamic conditions, that is to say by subjecting the nonwoven material or the foam to impulses of 20 cN/cm$^2$ twice a second.

The fourth parameter measured is the ventilation rate:V expressed in %

$$V = \frac{R_{et} \text{ under static conditions} - R_{et} \text{ under dynamic cond.}}{R_{et} \text{ under static conditions}}$$

The results of these comparative tests are given in the following tables: Static conditions:

TABLE 1

| | $R_{ct}$ (m$^2$ K/W) | $R_{et}$ (m$^2$ mbar/w) | Fi (%) |
|---|---|---|---|
| Foam | 7.626 | 1.715 | 3.6 |
| Nonwoven material | 7.931 | 1.279 | 5.3 |

Dynamic conditions:

TABLE 2

| | $R_{ct}$ (m$^2$ K/W) | $R_{et}$ (m$^2$ mbar/w) | Fi (%) |
|---|---|---|---|
| Foam | 3.454 | 1.318 | 0.7 |
| Nonwoven material | 4.161 | 0.867 | 1.0 |

It may be concluded from these tables that, although it has a slightly higher thermal resistance, the nonwoven material has a lower humidity transport resistance and better humidity absorption capacity than the foam layer.

The ventilation rate amounts for the nonwoven material to 32% ((1.279–0.867)/1.279) and for the foam layer to 23% ((1.715–1.318)/1.715), which means that the effect of vibration and movements results in a more substantial increase of humidity transfer in the case of the nonwoven material than in the case of the foam layer.

EXAMPLE 2

The nonwoven material used in accordance with the invention comprises three types of fibres: 1) and 2) A standard mixture of two types of fibres bearing the reference "D-291 Quallofil ®" of the Dupont de Nemours Company, consisting of hollow four-channel fibres of the "thermobonding" type and polyester fibres, of 13 dtex, the length of which varies between 7 and 8 cm. 3) "Vivrelle ®" fibre type 950 of the SNIA Company, of a thickness of 3.3 dtex and a length varying from 3.5 to 4.5 cm.

These three types of fibres were mixed in a ratio of 70% of the "D-291 Quallofil ®" mixture to 30% of "Vivrelle ®" fibres.

The mixture of fibres was carded and lapped in accordance with techniques well known to those skilled in the art. The fibres were then needle bonded and heat bonded.

The material thus obtained has a thickness of 11 mm and an apparent density of 35 kg/m. It has a compressive strength such that, when it is subjected to a static pressure of 20 cN/cm$^2$, it retains a thickness of 7 mm.

EXAMPLE 3

The covering for passenger transport seats according to the invention comprises the nonwoven material whose characteristics are given in Example 1, and the cover fabric "MILPOINT ®" of the Guilford Company. This material and this fabric were adhesive bonded to one another by means of a thermoplastic powder of the copolyester type, applied by sprinkling.

We claim:

1. Covering for seats intended for passenger transport, characterised in that it comprises a cover fabric and a nonwoven material which is produced by a dry process, the said material having an apparent density between 20 and 100 kg/m$^3$ and a thickness between 4 and 40 mm and comprising a minimum of 50% of synthetic fibres of a thickness of 3 to 40 dtex and a length of 2 to 12 cm, which are needle bonded, the said material having a minimum thickness of 2 mm when a static pressure of 20 cN/cm$^2$ is applied to it.

2. Covering according to claim 1, characterised in that the said material is adhesive bonded to the said cover fabric.

3. Covering according to claim 1, characterised in that the said material has an apparent density between 30 and 60 kg/m$^3$.

4. Covering according to claim 1, characterised in that the said material has a thickness between 8 and 12 mm.

5. Covering according to of claim 1, characterised in that the said synthetic fibres are selected from the group comprising polyester fibres, polyamide fibres, polyoxyamide fibres or fibres of the "superabsorbent" type, or a mixture thereof

6. Covering according to claim 1, characterised in that the fibres have a thickness between 6 and 20 dtex.

7. Covering according to claim 1, characterised in that the said fibres have a length between 5 and 7.5 cm.

8. Covering according to claim 1, characterised in that the said fibres are both needle bonded and heat bonded.

9. Covering according to claim 1, characterised in that the said fibres are both needle bonded and chemically bonded.

10. Covering according to claim 1, characterised in that the said material has a minimum thickness of 4 mm when a static pressure of 20 cN/cm$^2$, is applied to it.

11. Covering according to claim 2, characterised in that the said material has an apparent density between 30 and 60 kg/m$^3$.

12. Covering according to claim 2, characterised in that the said material has a thickness between 8 and 12 mm.

13. Covering according to claim 2, characterised in that the said synthetic fibres are selected from the group comprising polyester fibres, polyamide fibres, polyoxyamide fibres or fibres of the "superabsorbent" type, or a mixture thereof.

14. Covering according to claim 2, characterised in that the fibres have a thickness between 6 and 20 dtex.

15. Covering according to claim 2, characterised in that the said fibres have a length between 5 and 7.5 cm.

16. Covering according to claim 2, characterised in that the said fibres are both needle bonded and heat bonded.

17. Covering according to claim 2, characterised in that the said fibres are both needle bonded and chemically bonded.

18. Covering according to claim 2, characterised in that the said material has a minimum thickness of 4 mm when a static pressure of 20 cN/cm$^2$ is applied to it.

* * * * *

UNITED STATES PATENT AND TRADEMARK OFFICE

CERTIFICATE OF CORRECTION

PATENT NO. : 5,292,577

DATED : March 8, 1994

INVENTOR(S) : VAN KERREBROUK et al.

It is certified that error appears in the above-indentified patent and that said Letters Patent is hereby corrected as shown below:

On title page, item, [57] ABSTRACT, line 6, change "kg/m" to ---kg/$m^3$---;

Column 3, line 58, change "$R_{ct}$" to ---$R_{et}$---; and

Column 5, line 19, delete "of".

Signed and Sealed this

Twenty-ninth Day of November, 1994

*Attest:*

Bruce Lehman

BRUCE LEHMAN

*Attesting Officer*

*Commissioner of Patents and Trademarks*